United States Patent [19]

Alonzo

[11] Patent Number: 4,466,591

[45] Date of Patent: Aug. 21, 1984

[54] BRACKET ELEMENT FOR SUPPORTING HANGING DEVICES

[76] Inventor: Peter L. Alonzo, 2918 Virginia, McHenry, Ill. 60050

[21] Appl. No.: 321,803

[22] Filed: Nov. 16, 1981

[51] Int. Cl.[3] ..... A47B 96/06

[52] U.S. Cl. ..... 248/217.1; 248/216.1

[58] Field of Search ..... 248/217.1, 208, 216.1, 248/262, 267, 254, 255

[56] References Cited

U.S. PATENT DOCUMENTS

| | | | |
|---|---|---|---|
| 830,245 | 9/1906 | Moore | 248/254 |
| 919,988 | 4/1909 | Witzal | 248/254 |
| 1,012,369 | 12/1911 | Kolb | 248/267 |
| 1,034,977 | 8/1912 | Childress | 248/254 |
| 1,124,829 | 1/1915 | Allen | 248/254 |
| 1,139,729 | 5/1915 | Rounds | 248/267 |
| 1,250,823 | 12/1917 | Erickson | 248/254 |
| 1,391,528 | 9/1921 | Cranford | 248/267 |
| 1,662,927 | 3/1928 | Kirsch | 248/267 |
| 2,001,864 | 5/1935 | Benjinsohn | 248/267 |
| 2,481,802 | 9/1949 | Wadkins | 248/254 |
| 3,614,045 | 10/1971 | Cegielski, Jr. | 248/262 |

FOREIGN PATENT DOCUMENTS

| | | | |
|---|---|---|---|
| 0537706 | 5/1922 | France | 248/254 |

*Primary Examiner*—William H. Schultz
*Assistant Examiner*—Ramon O. Ramirez
*Attorney, Agent, or Firm*—Neuman, Williams, Anderson & Olson

[57] ABSTRACT

A bracket element for supporting curtain rods, window shades and a variety of other hanging devices from the trim about a window or door frame. In one embodiment, a corner-mounting bracket element has a horizontal first leg with wedge-shaped teeth for engaging the upper surface of the trim and a vertical second leg rigidly connected thereto to form a right angle. Receiving means are disposed within the vertical second leg to permit attachment of a hanging device such as, for example, a curtain rod fixture. Extension members depend from the ends of the first and second legs and abut the adjacent wall structure, thereby providing further support and alignment of the bracket element. The bracket element is installed by the top of a hammer and can be easily removed for redecorating or replacement with minimal defacement of the trim and adjacent wall structure.

1 Claim, 10 Drawing Figures

FIG. 1
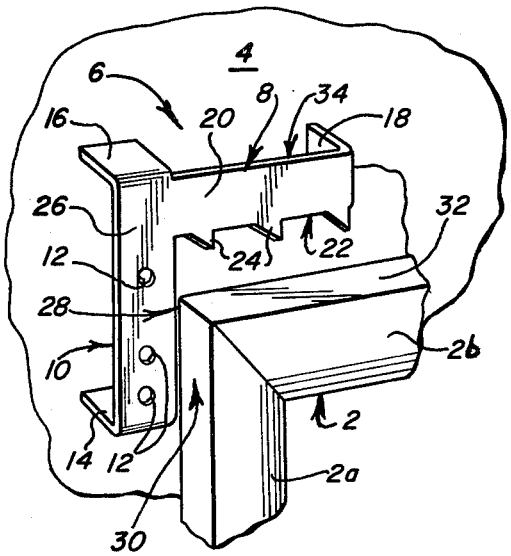
FIG. 2
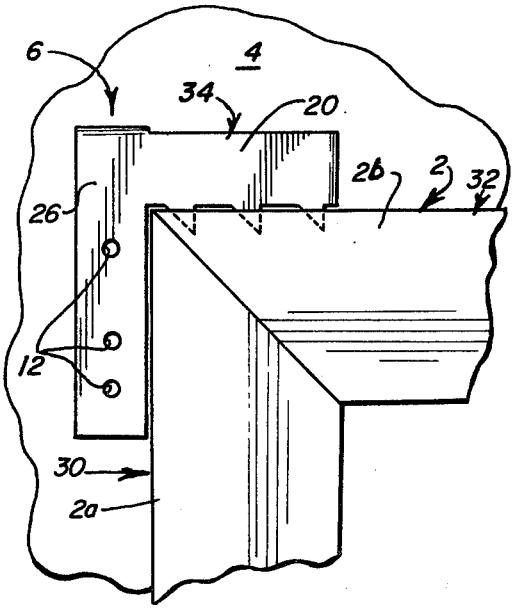
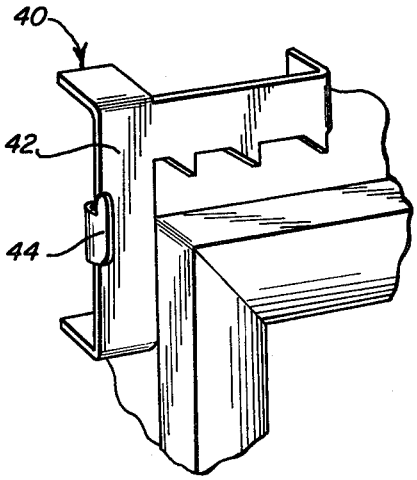
FIG. 4
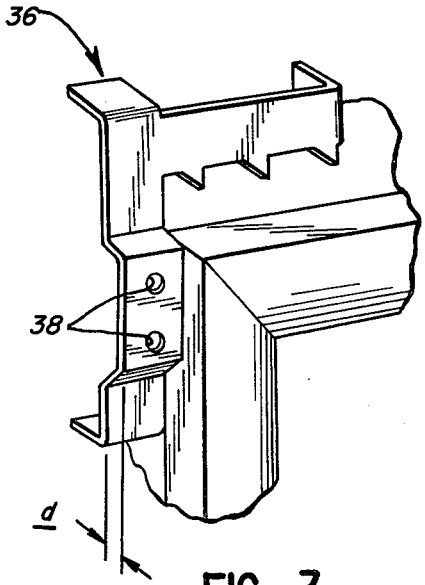
FIG. 3

FIG. 5
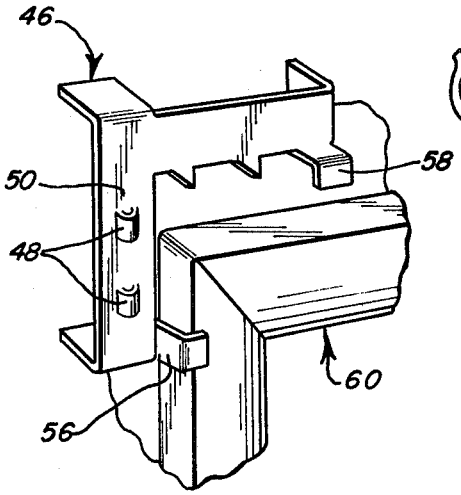
FIG. 6
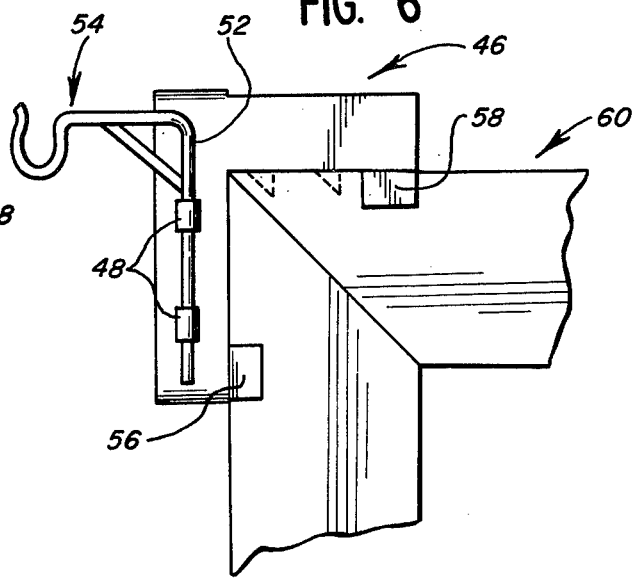
FIG. 7
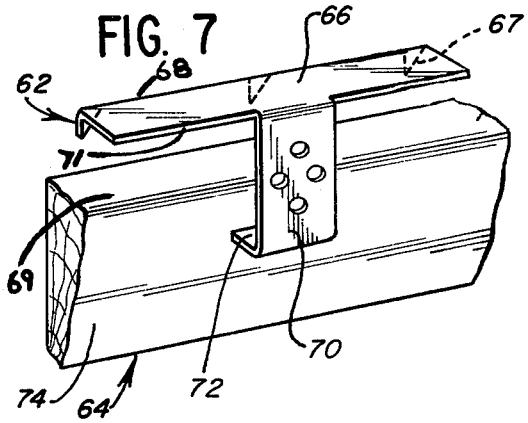
FIG. 8
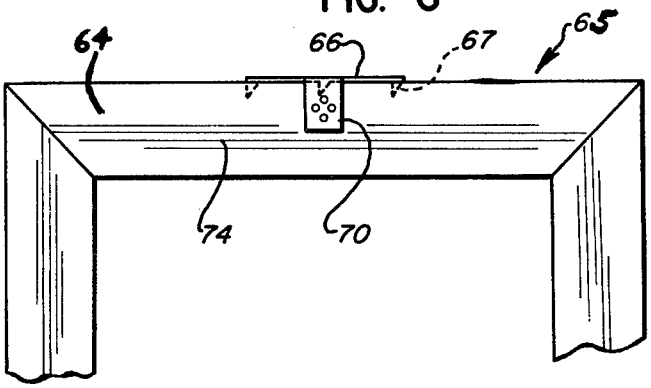
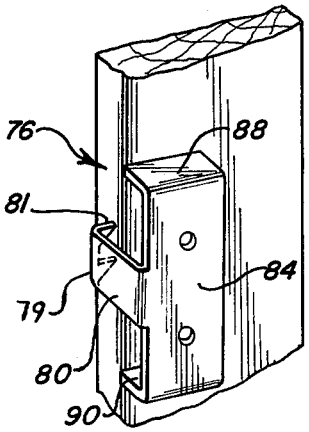
FIG. 9
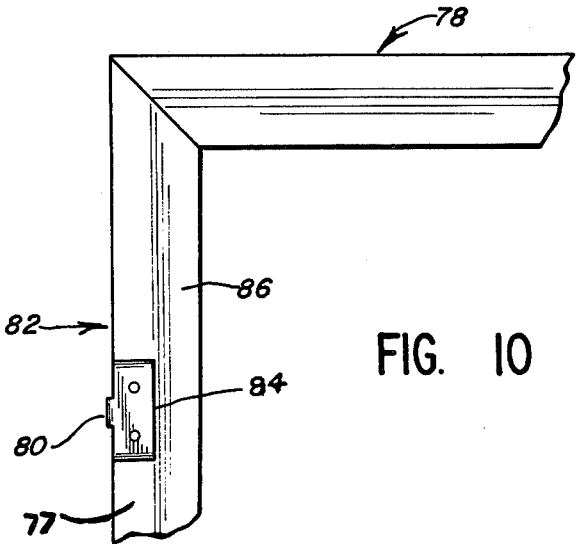
FIG. 10

BRACKET ELEMENT FOR SUPPORTING HANGING DEVICES

BACKGROUND OF THE INVENTION

This invention relates to a bracket element for supporting curtain rods, window shades, and the like, and more particularly to an apparatus which may be simply and removably affixed to a frame means, such as the wooden trim about a window or door, and which may be adapted to securely support a variety of hanging devices.

Heretofore, several devices have been proposed for supporting curtain rods, window shades and other hanging devices. However, such prior art devices have required for their installation the use of nails, screws, suction cups or adhesives to affix them to a trim, frame or wall. Thus, proper mounting of the aforesaid devices has required a certain amount of skill in placing, aligning, and attaching the devices, and it has also required a variety of tools along with dexterity in their use. Furthermore, when the devices were removed for replacement, painting, wallpapering, or redecorating, it was necessary to repair, resurface and repaint that portion of the wall or trim which had been defaced by the mounting of the device.

SUMMARY OF THE PRESENT INVENTION

The present invention relates to a novel bracket element for supporting curtain rods, window shades, and the like from the trim about a window or door. The bracket element has a grappling member, which can be a part with wedge-shaped teeth depending from it, and a base member which can include receiving means for mounting a variety of hanging devices. Extension members depending from either or both of the grappling and base members, and abutting the trim or adjacent wall structure, serve to support the bracket element and align it with respect to the trim or adjacent wall structure. The bracket element is installed by placing the bracket element in position adjacent to the trim and then tapping the grappling member into the trim with a hammer. It can be easily removed for redecorating or replacement with minimal defacement of the trim and adjacent wall structure.

It is an object of the present invention to provide a simple and inexpensive bracket element by means of which fixtures commonly used to support curtain rods, window shades and other hanging devices may be readily positioned and affixed to the trim about a window or door frame by persons of little skill and ability.

It is another object of the present invention to provide a bracket element of the above type which requires for mounting no additional hardware or tools other than a hammer.

It is a still further object of this invention to provide a bracket element which is suitable for use with a variety of window frame or door frame configurations.

It is yet another object of this invention to provide a bracket element which can be easily removed from the trim about a window or door frame to which it is attached for the purpose of painting, wallpapering or redecorating; and the use of which will minimize or eliminate defacement of and damage to such trim.

BRIEF DESCRIPTION OF THE DRAWINGS

The above and other objects of this invention will become more apparent from the following description, taken in connection with the accompanying drawings, in which:

FIG. 1 is a perspective view of a corner-mounting bracket element according to the present invention having apertures for attaching a hanging device, the bracket element shown superposed and positioned for removable mounting on a corner of said frame means.

FIG. 2 is a front elevational view of the bracket element of FIG. 1 mounted on a frame means.

FIG. 3 is a perspective view of an alternative embodiment, similar to FIG. 1, with apertures offset from the remainder of the bracket element.

FIG. 4 is a perspective view of an alternative embodiment, similar to FIG. 1, with a protruding hook for receiving one end of a conventional curtain rod.

FIG. 5 is a perspective view of an alternative embodiment, similar to FIG. 1, with extension members conforming to the configuration of the frame means and a sheath for receiving a pintle section of a hanging device.

FIG. 6 is a front elevational view of the bracket element of FIG. 5 shown mounted on a frame means with a pintle of a hanging device inserted into the sheath.

FIG. 7 is a perspective view of a top-mounting bracket element according to the present invention having apertures for attaching a hanging device, the bracket element shown superposed and positioned for removable mounting on the top of said frame means.

FIG. 8 is a front elevational view of the bracket element of FIG. 7 mounted on a frame means.

FIG. 9 is a perspective view of a side-mounting bracket element according to the present invention having apertures for attaching a hanging device, superposed and positioned for removable mounting on a side of said frame means.

FIG. 10 is a front elevational view of the bracket element of FIG. 9 shown mounted on a frame means.

DESCRIPTION OF THE PREFERRED EMBODIMENTS

Referring to FIG. 1 and FIG. 2, and using like numbers to designate like portions, reference numeral 2 designates a conventional frame means, in this illustration the wooden trim about a window frame. A left side vertical portion **2*a* is joined with a top horizontal portion 2*b* to form a substantially perpendicular upper left corner of frame means 2. The frame means typically surrounds a window or door-receiving recess, or the trim thereabout, secured within or attached to an adjacent structure 4** such as a wall or other structural member. It is understood that for structural or aesthetic reasons the frame means may be constructed in different sizes and shapes. Moreover, the frame means may be composed of any penetrable material such as, for example, wood or particle board.

The illustrated bracket element 6 is particularly designed for mounting on the upper left corner of frame means 2 and includes a grappling member 8, a base member 10, receiving means 12 and contact means in the form of extension members 14, 16 and 18. A mirror image configuration may be used for the upper right corner.

The grappling member 8 includes a rigid horizontal leg 20 having a linear facing edge 22 generally coextensive with said member 8. Two or more wedge-shaped pointed teeth 24 depend from said member 8 and are generally co-planar therewith for securing the bracket element 6 to the corner of frame means 2. It will be appreciated that alternative means may be employed for securing the bracket element 6 to the frame means 2. The wedge-shaped pointed teeth 24 that are integral with the bracket element are preferred because they are usually stronger and more easily fabricated. Also, they are resistant to breakage off the bracket element during handling, use and reuse.

The base member 10 is a stiff vertical leg 26 which is rigidly attached to and depends from one end of leg 20 at a substantially right angle, or some other angle corresponding to the configuration of frame means 2. The base member also has a linear facing edge 28 generally coextensive therewith.

The receiving means are generally located in the base member of the bracket element, as opposed to the grappling member. In FIG. 1 and FIG. 2, the receiving means comprise a convenient number of apertures 12 such as, for example, screw holes for attachment of a hanging device like a curtain rod or window shade. Where it is necessary to secure a relatively small hanging device or fixture component to the bracket element with screws, it is frequently possible to do so prior to the mounting of the bracket element. Convenience and safety are thereby promoted through the avoidance of having to mount or adjust fixture elements from atop a stepladder. As will be described hereinafter, a variety of receiving means may be adopted for use with particular types of hanging devices.

In the bracket element 6, contact means are formed as substantially perpendicular extensions 14, 16 and 18 of the legs and members from which they extend. These contact means extend to the frame means 2 and adjacent structure 4, making contact with their sides and ends, to aid in placing, supporting and aligning the bracket element with respect to the frame means and adjacent structure. They may be of any desireable length or configuration. The dimensions and strength properties of the bracket element 6, as well as others disclosed herein, may vary as necessary or desirable to suit a variety of circumstances. By way of example and not limitation, the bracket element may be made from 1/16" thick steel, with the grappling member 8 approximately $1\frac{1}{2}$" long, the base member 10 approximately $2\frac{1}{4}$" long, and the contact means 14, 16 and 18 approximately $\frac{1}{4}$" long.

Bracket element 6 is affixed to frame means 2 by bringing the linear facing edge 28 of leg 26 into positional alignment with the left side edge 30 of portion 2*a* of frame means 2, the wedge-shaped teeth 24 and the linear facing edge 22 of leg 20 into positional alignment with the top edge 32 of portion 2*b* of frame means 2, and the contact means 14, 16 and 18 in contact with the adjacent wall structure 4. Thus, the bracket element is simply positioned and no measurements are required. Top edge 34 of leg 20 is then tapped with a hammer to drive the wedge-shaped teeth 24 into the top edge 32 of portion 2*b* of frame means 2. The wedge-shaped teeth 24 secure the bracket element and the base member and extension members prevent pivoting about either leg 20 or leg 26.

Extension member 14 acts in cooperation with the wedge-shaped teeth 24 to prevent rotation about the longitudinal axis of leg 26. Similarly, extension member 18 acts in cooperation with the wedge-shaped teeth 24 to prevent rotation about the longitudinal axis of leg 20. By positioning the illustrated bracket element 6 on the frame means 2 so that extension members 14, 16 and 18 abut the adjacent wall, additional resistance to rotation about the longitudinal axis of leg 20 is provided by extension member 16. Once the bracket element is positioned, the weight of the attached curtain rod, window shade or the like will assist in maintaining the bracket in position.

FIG. 3 is an alternative construction 36 of the corner-mounting bracket element of FIG. 1 showing the apertures 38 offset a distance d in parallel relation from the face of the remainder of the bracket element 36. FIG. 4 is an alternative construction 40 of the corner-mounting bracket element of FIG. 1 showing alternative receiving means. Instead of apertures, the base member 42 includes a hook 44 extending perpendicularly outward from the face thereof for receiving one end of a conventional curtain rod. As necessary or desirable, many such configurations may be fabricated with offsets of varying distance and receiving means for a variety of items, in accordance with the principles of the this invention, to accommodate various shapes and sizes of frame means.

FIG. 5 and FIG. 6 illustrate an alternative construction 46 of the corner-mounting bracket element of FIG. 1 and show additional examples of receiving means and contact means. The illustrated receiving means comprise a sheath 48 within base member 50 for receiving the corresponding pintle section 52 of a hanging device 54. Such a device is frequently used to hang plants. Thus, it can be seen that the present invention is not limited to use with curtain rods and window shades. The bracket element 46, in combination with the hanging device 54, provides a simple and effective mechanism for hanging plants near a window. Similarly, macrame, mobiles, chimes and other items may be supported by one or more such bracket elements and hanging devices.

Additionally, FIG. 5 and FIG. 6 show extension members 56 and 58 fabricated so as to conform to the shape of frame means 60 and lend additional support. The extension members may be fabricated in various lengths and shapes in order that the user may select a bracket element suitable for use with a particular configuration of frame means.

FIG. 7 and FIG. 8 show a bracket element 62 particularly designed for mounting on the upper portion 64 a frame means 65. The grappling member in this embodiment is a shelf-like part 66 having wedge-like teeth 67 depending from its rear longitudinal edge 68 for mounting on the top edge 69 of the upper portion of frame means 65. The base member is a vertical leg 70 which depends from the mid-portion of the forward longitudinal edge 71 of the shelf-like part 66, generally at a right angle. An extension member 72 extends inward from the bottom edge of vertical leg 70 to abut the front face 74 of the frame means 64. The length of the extension member 72, and the angle between the shelf-like part 66 and vertical leg 70 may vary as necessary or desirable to accommodate frame means of different configurations. Bracket element 62 is affixed to frame means 65 by hammering shelf-like part 66 and the wedge-like teeth 67 into the top edge 68 of the upper portion of frame means 65, much in the same manner as the bracket elements of FIGS. 1–6. Bracket element 62 can be situated anywhere along the top horizontal portion of a frame means and provides, in addition to support for various hanging devices, additional support for fixtures which span the width of such frame means.

FIG. 9 and FIG. 10 show a bracket element 76 designed for mounting on the side portion 77 of a frame means 78. The grappling member comprises a first leg 80 having wedge-like teeth 81 extending from its rear edge for mounting on the side edge 82 of the side portion of frame means 78. The base member is a vertical second leg 84 which is attached to the forward edge of leg 80 so as to form a substantially right angle, with leg 84 generally parallel and overlapping the front face 86 of the side portion 77 of frame means 78. Bracket element 76 is affixed to frame means 78 by hammering the outside face 78 of leg 80 and the wedge-like teeth 81 into the side edge 82 of the side portion of frame means 78. Extension member 88 and 90 extend inwardly from the upper and lower edges of leg 84 and abut the front face 86 of the side portion of frame means 78. Bracket element 76 can be used for, among other things, the hanging of cafe curtain fixtures.

It will be noted that the bracket elements described herein, and obvious variations thereof, provide for a simple and efficient method of hanging various items near window and door frames. Since mounting of such devices is accomplished with wedge-shaped teeth which, upon removal, leave only small marks in the trim not visible to the casual observer, optimum utility for decorating purposes is found in the present invention. The aforementioned elements require only a hammer for installation and can be mounted quickly and safely.

It is believed that the embodiments here illustrated and described have made apparent a number of modifications which can be made in the invention disclosed by those skilled in the art without departing from the spirit and scope of these principles. Accordingly, it is intended that this invention be limited only by the scope of the appended claims.

Having thus set forth and disclosed the nature of my invention, I claim:

1. A one piece bracket element for supporting curtain rods, window shades and other hanging devices from a frame means attached to an adjacent structure, said bracket element comprising:

a grappling member adapted to releasably engage the horizontal edge of an upper corner portion of such frame means;

a base member adapted to rest against the vertical edge of said upper corner portion of such frame means, said base member being rigidly connected at its upper end to one end of said grappling member;

a first contact member extending perpendicularly rearward from the lower end of said base member and adapted to rest against said vertical edge of said upper corner portion of such frame means to facilitate placement and alignment of said bracket element with respect to such frame means and adjacent structure to prevent rotation of the mounted bracket element about the longitudinal axis of said base member;

a second contact member extending perpendicularly rearward from the free end of said grappling member and adapted to rest against said horizontal edge of said upper corner portion of such frame means to facilitate placement and alignment of said bracket element with respect to such frame means and adjacent structure and to prevent rotation of the mounted bracket element about the longitudinal axis of said grappling member;

a third contact member extending perpendicularly rearward from the upper end of said base member; and receiving means located within a segment of said base member for mounting various types of hanging devices.

* * * * *

UNITED STATES PATENT AND TRADEMARK OFFICE

CERTIFICATE OF CORRECTION

PATENT NO. : 4,466,591

DATED : August 21, 1984

INVENTOR(S) : PETER L. ALONZO

It is certified that error appears in the above-identified patent and that said Letters Patent is hereby corrected as shown below:

Abstract, line 14, "top" should read -- tap --. Column 4, line 19, delete "the" second occurrence. Column 5, line 11, correct "member" to read -- members --. Column 5, line 25, after "aforementioned" insert -- bracket --. Column 6, line 19, Claim 1, after "structure" insert -- and --.

Signed and Sealed this

*Twenty-sixth* Day of *February 1985*

[SEAL]

*Attest:*

DONALD J. QUIGG

*Attesting Officer*

*Acting Commissioner of Patents and Trademarks*